US009332336B2

(12) United States Patent
Fukushima

(10) Patent No.: US 9,332,336 B2
(45) Date of Patent: May 3, 2016

(54) HEADPHONE DEVICE

(75) Inventor: Yoshinari Fukushima, Kanagawa (JP)
(73) Assignee: D&M Holdings, Inc., Kanagawa (JP)

( * ) Notice: Subject to any disclaimer, the term of this patent is extended or adjusted under 35 U.S.C. 154(b) by 125 days.

(21) Appl. No.: 14/346,152
(22) PCT Filed: Mar. 30, 2012
(86) PCT No.: PCT/JP2012/058545
§ 371 (c)(1),
(2), (4) Date: Mar. 20, 2014
(87) PCT Pub. No.: WO2013/042389
PCT Pub. Date: Mar. 28, 2013

(65) Prior Publication Data

US 2014/0226833 A1 Aug. 14, 2014

(30) Foreign Application Priority Data

Sep. 21, 2011 (JP) ..... 2011-205756

(51) Int. Cl.
*H04R 1/10* (2006.01)
*H04R 1/40* (2006.01)

(52) U.S. Cl.
CPC ..... *H04R 1/1058* (2013.01); *H04R 1/1075* (2013.01); *H04R 1/403* (2013.01)

(58) Field of Classification Search
None
See application file for complete search history.

(56) References Cited

U.S. PATENT DOCUMENTS 6,356,644 B1 * 3/2002 Pollak ..... H04R 1/1008 181/129
2005/0207606 A1 * 9/2005 Yang ..... H04R 1/1075 381/370
2008/0049959 A1 * 2/2008 Yang ..... H04R 1/1075 381/370
2011/0317856 A1 12/2011 Akasu
2012/0087532 A1 * 4/2012 Yang ..... H04R 1/10 381/380

FOREIGN PATENT DOCUMENTS

| | | |
|---|---|---|
| JP | 62-39394 | 3/1987 |
| JP | 039394/1987 | 3/1987 |
| JP | 20085-98290 A | 4/2008 |
| JP | 3150873 | 5/2009 |
| JP | 3150873 | 6/2009 |

* cited by examiner

*Primary Examiner* — Thang Tran
(74) *Attorney, Agent, or Firm* — Peter A. Nieves; Sheehan Phinney Bass & Green PA

(57) ABSTRACT

[Problem] To provide a headphone device that outputs an audio signal output from a playback device, such that the headphone device has a more compact housing while being capable of highly sensitive acoustic output of an audio signal having high sound quality, and is capable of consuming less power during highly sensitive acoustic output of an audio signal having high sound quality. [Solution] In a headphone device that outputs an input audio signal, the headphone device is provided with: a housing shaped with a hollow interior, said housing being provided with a projection on the front thereof, said projection being provided with a hole passing therethrough in the front-to-back direction; and a first driver unit and second driver unit each affixed to the inner wall of the housing, and each having a diaphragm that acoustically outputs the input audio signal. The first driver unit and the second driver unit have been given a parallel arrangement, such that the diaphragms thereof are in mutual opposition.

10 Claims, 5 Drawing Sheets

HEADPHONE DEVICE

TECHNICAL FIELD

The present invention relates to a headphone device which is to be connected to a playback device to output an audio signal that is output from the playback device.

BACKGROUND ART

As a related-art headphone device, a headphone device is known which is electrically connected to a playback device via a cable and which outputs an audio signal that is output from the playback device (see, for example, Patent Literature 1).

FIG. 5 is a schematic structural view illustrating a related-art headphone device.

A headphone device 100 includes two housings 200, two front portions 300, and two ear pads 4. Each of the housings 200 is connected to an input terminal 8 via a cable 6. The cable 6 includes a lead provided therein. The input terminal 8 is connected to an output terminal 11 of a playback device 10. The playback device 10 reproduces an audio signal, and outputs the reproduced audio signal from the output terminal 11.

The headphone device 100 includes, in addition to the structure described with reference to FIG. 5, driver units and bushes (not shown). The driver unit is fixedly bonded to a rear surface of the front, portion 300 using an adhesive or the like. The driver unit includes a magnetic circuit (not shown) which itself includes a voice coil (not shown), a magnet (not shown), and the like, a diaphragm (not shown), and the like, and is electrically connected to the input terminal 3 via the cable.

The ear pad 4 is formed, in the shape of a cylinder of an elastic body such as a rubber member, and includes a through hole (not shown) in a fore-and-aft direction. The ear pad 4 is in a state of being held, in front of the front portion 300.

In the headphone device 100, an audio signal which is output from the output terminal 11 of the playback device 10 is input via the input terminal 8, and the audio signal which is input from the input terminal 8 is input to the driver unit via the lead in the cable 6. The driver unit converts the input audio signal into a vibration by using the magnetic circuit. Transfer of the vibration via the voice coil to the diaphragm causes the audio signal to be emitted. A user of the headphone device 100 reproduces the audio signal from the playback device 10 under a state in which the ear pads 4 are inserted into the user's ears and, for example, the playback device 10 is in a pocket of the user's clothes. With this, the audio signal reproduced by the playback device 10 is emitted by a driver unit 7 via the input terminal 8 and the cable 6. The emitted studio signal is transferred to the inside of the ear pads 4 via holes in the front portions 300. This transfers the audio signal to the ears of the user to which the ear pads 4 are attached, and the user can listen to the audio signal which is output from, the headphone device 100.

CITATION LIST

Patent Literature

[PTL 1] JP 8-098290 A

SUMMARY OF INVENTION

Technical Problems

In a related-art headphone device, an audio signal which is emitted from a driver unit is emitted as a vibration, and thus, it is often the case that the sensitivity and the sound quality of the emitted audio signal depend on the size of the driver unit. For example, by increasing the size of a magnet in the driver unit, a magnetic flux to be generated can be increased, and, by increasing the area of a diaphragm in the driver unit, an effective vibration area can be increased, and thus, the sound pressure of the emitted audio signal can be increased. Therefore, when, for example, an audio signal of high sensitivity and high sound quality is required to be emitted, by increasing the magnetic flux density of a voice coil by using a driver unit having a large magnetic circuit and a large diaphragm, an audio signal of high sensitivity and high sound quality can be emitted. However, in the headphone device 100 illustrated in FIG. 5, usage of a driver unit including a large magnetic circuit and a large diaphragm increases the size of a housing, and, when the ear pad 4 is inserted into an ear, the housing which protrudes from the ear is exposed and the sense of wearability of the headphone device 100 is deteriorated.

As a measure for emitting an audio signal of high sensitivity and high sound quality while preventing such increase in size of the housing, for example, it is conceivable to emit an audio signal of nigh sensitivity and high sound quality by providing a plurality of small driver units in the housing and emitting audio signals from, the plurality of driver units. However, in a structure in which a plurality of driver units are provided in a housing, vibrations which are emitted from the respective driver units interfere with one another, which may cause distortion to the audio signals by disturbing the frequency characteristics of the emitted audio signals. Further, in a structure in which a plurality of driver units are provided in a housing, it is necessary to input an audio signal to each of the driver units, which increases the power consumption required for the playback device to output an audio signal to each of the driver units. Further, an ordinary playback device is limited in the output level of an audio signal which can be output, and thus, even if, for example, the playback device outputs an audio signal at the maximum output level, the audio signal which is output from the playback device is dispersed, to the plurality of driver units. Thus, a high-volume audio signal cannot be emitted from, each of the driver units, and an audio signal of high sensitivity and high sound quality cannot be emitted.

It is an object of the present invention to provide a headphone device for outputting an audio signal which is output from, a playback device, which can emit an audio signal of high-sensitivity and high sound quality while reducing the size of a housing and which can emit an audio signal of high sensitivity and high sound quality with lower power consumption.

Solution to Problems

According to the invention according to claim 1 of this application, there is provided a headphone device for outputting an input audio signal, including: a housing in a shape having a cavity formed therein, the housing including a protrusion at a front thereof, the protrusion having a through, hole in a fore-and-aft direction; and a first driver unit and a second driver unit, each being fixed to an inner wall of the housing and each including a diaphragm for emitting an input audio signal, in which, the first driver unit and the second driver unit are arranged in parallel with each other so that the diaphragms thereof are opposed to each other.

According to the invention according to claim 2 of this application, there is provided a headphone device for outputting an input audio signal, including: a housing in a shape having a cavity formed therein, the housing including a protrusion at a front thereof, the protrusion having a through hole in a fore-and-aft direction; and a first driver unit and a second driver unit, each being fixed to an inner wall of the housing and each including a diaphragm, for emitting an input audio signal, in which the first driver unit and the second driver unit are arranged so that the diaphragms thereof are opposed to each other and the diaphragms are slanted by a predetermined angle.

According to the invention according to claim 3 of this application, in the headphone device according to claim 1 or 2, a distance from the diaphragm of the first driver unit, to the diaphragm of the second driver unit is approximately 2 mm.

According to the invention according to claim 4 of this application, in the headphone device according to any one of claims 1 to 3, the through, hole is provided at a position which is substantially perpendicular to the first driver unit and the second driver unit.

Advantageous Effects of Invention

According to the present invention, it is possible to provide the headphone device for outputting an audio signal, which is output from a playback device, which can emit an audio signal of high sensitivity and high sound, quality while reducing the size of the housing and which can emit an audio signal of high sensitivity and nigh sound quality with lower power consumption.

DESCRIPTION OF EMBODIMENT

Figure 5:
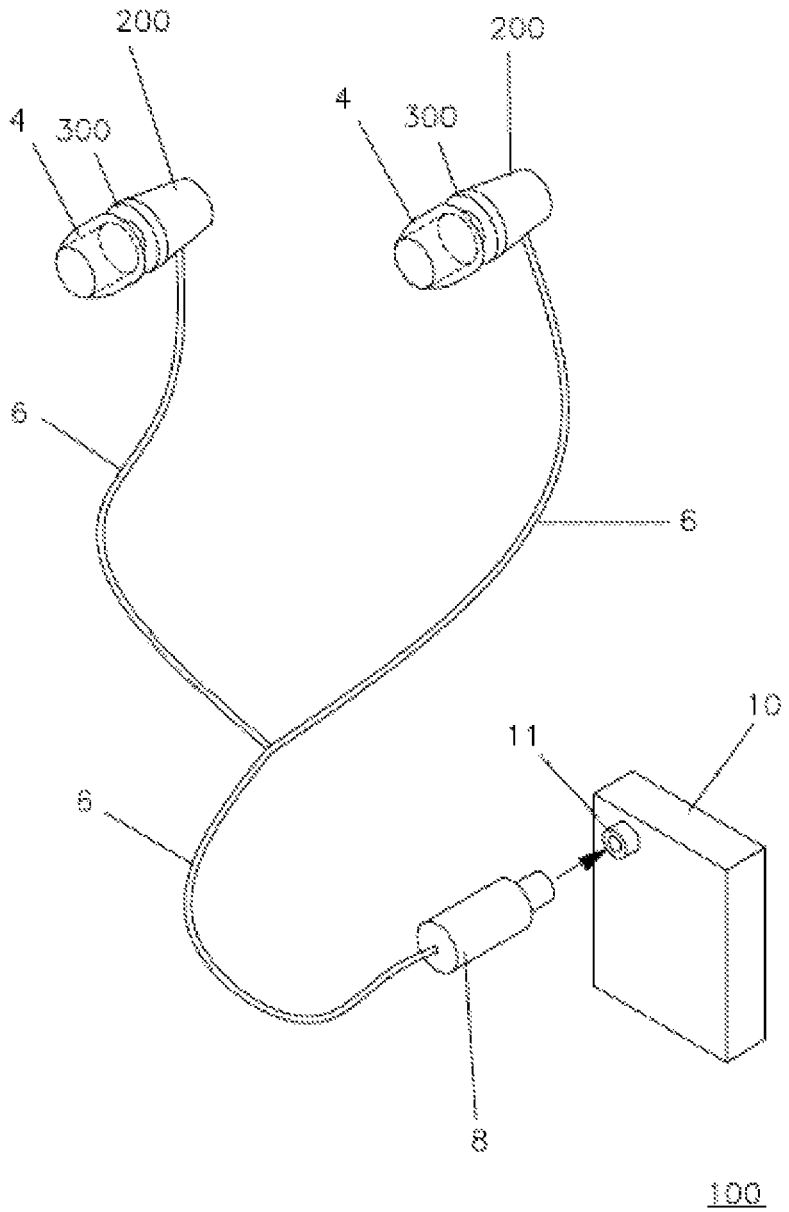
Fig.5 PRIOR ART
FIG. 5 is a schematic structural view illustrating a related-art headphone device.

An embodiment of the present invention is described with reference to the drawings. Note that, like reference numerals and symbols are used to designate like structural elements described in Background Art or illustrated in FIG. 5.

Figure 1:
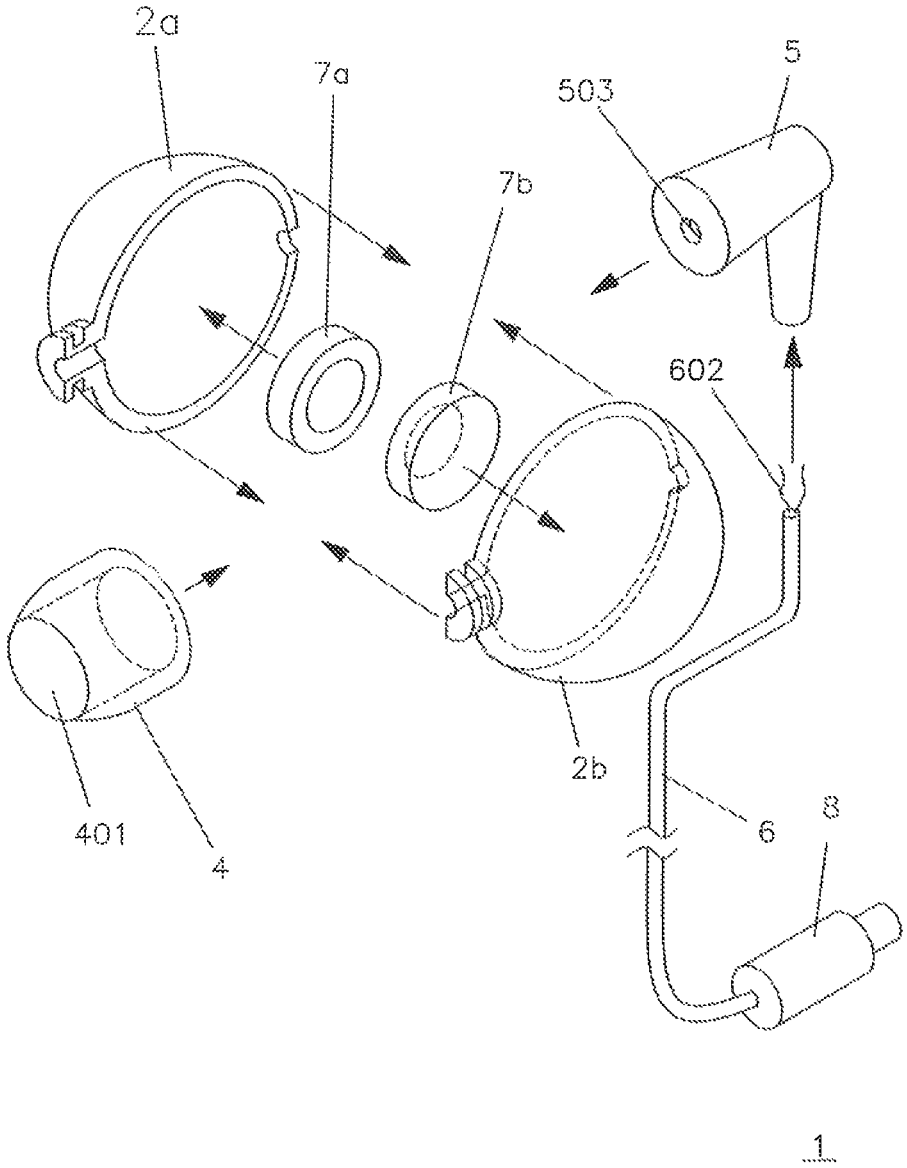
FIG. 1 is a schematic structural view illustrating a headphone device of an embodiment of the present invention.

FIG. 1 is a schematic structural view illustrating a headphone device of an embodiment of the present invention.

A headphone device 1 includes a housing 2*a*, a housing 2*b*, an ear pad 4, a bush 5, a cable 6, a first driver unit 7*a*, a second driver unit 7*b*, and an input terminal 8. The input terminal 8 has a structure which is similar to the structure described in Background Art, and thus, description thereof is omitted.

Figure 2:
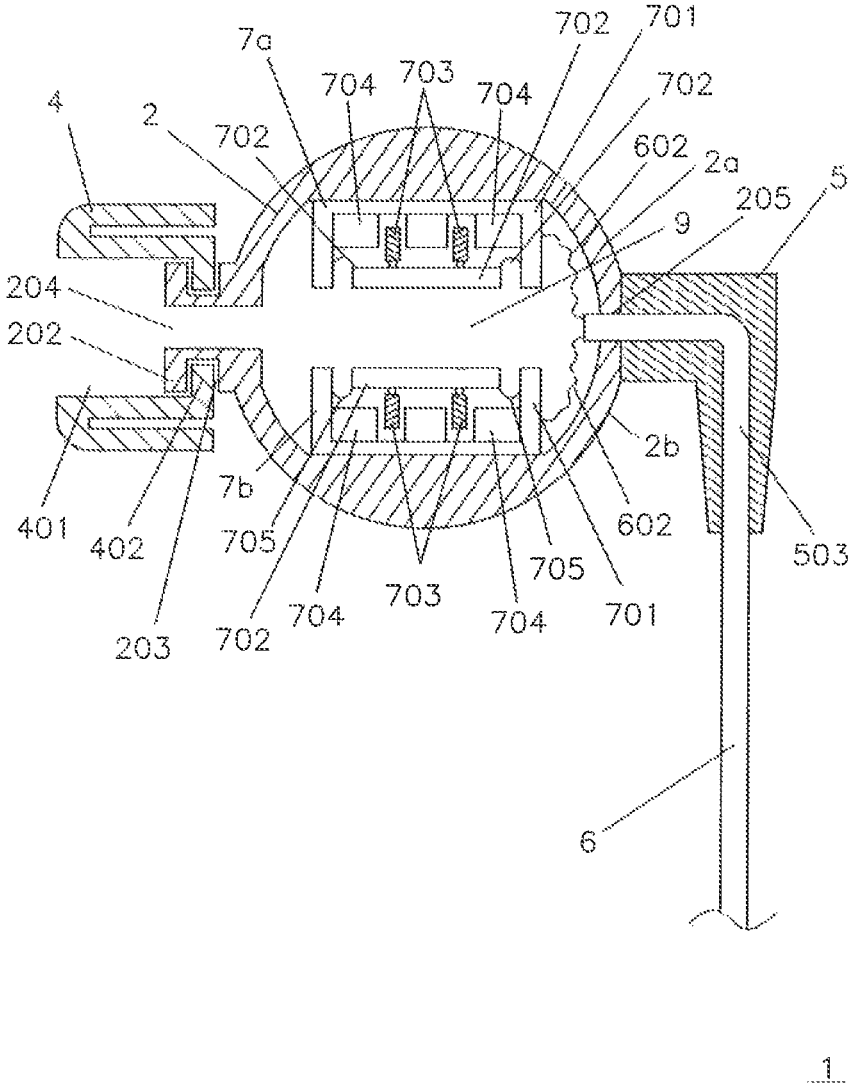
FIG. 2 is a sectional view illustrating a headphone device 1 of this embodiment.

FIG. 2 is a sectional view illustrating the headphone device 1 of this embodiment.

FIG. 2 is a sectional view seen from above of the headphone device 1 illustrated in FIG. 1. For the sake of description of the respective structures, a left direction is to the front of the headphone device 1, an upward direction is to the top of the headphone device 1, and a downward direction is to the bottom of the headphone device 1.

As illustrated in FIG. 1, the housing 2*a* and the housing 2*b* are symmetrical in shape and each form a hemispherical shape having a cavity formed therein. The housing 2*a* and the housing 2*b* form a sphere having a cavity formed therein by overlapping edges thereof. The first driver unit 7*a* is fixed to an inner wall of the housing 2*a* and the second driver unit 7*b* is fixed to an inner wall of the housing 2*b*.

In the following description, the housing 2*a* and the housing 2*b* are described as a housing 2 which forms a sphere having a cavity formed therein.

As illustrated in FIG. 1 and FIG. 2, the housing 2 includes a protrusion 202 which forms a cylinder at the front thereof. The protrusion 202 includes a through hole 204 in a fore-and-aft direction and includes a groove portion 203 in the middle of an outer periphery thereof. The housing 2 includes a through hole 205 in the fore-and-aft direction at the back thereof.

As illustrated in FIG. 1 and FIG. 2, the bush 5 forms a cylinder in the fore-and-aft direction with a rear portion thereof being bent substantially at a right angle to be formed into an L-shape, and is fixedly bonded to a rear portion of the housing 2 with an adhesive or the like. The bush 5 includes a through hole 503 which leads to the hole 205 in the housing 2 and is formed into an L-shape at the rear thereof.

The ear pad 4 is formed into the shape of a cylinder of an elastic body such as a rubber member, and includes a through hole 401 in the fore-and-aft direction. The ear pad 4 includes a flange portion 402 in a rear inner portion thereof. The ear pad 4 is in a state of being held in front of the housing 2 by fitting the flange portion 402 over the groove portion 203 in the housing 2.

The cable 6 includes a lead 602 provided therein. One end of the cable 6 is provided with the input terminal 8, and the other end is inserted into the housing 2 via the hole 503 in the bush 5 and the hole 205 in the housing 2.

Each of the first driver unit 7*a* and the second driver unit 7*b* includes a frame 701, a diaphragm 702, and a suspension 705, and includes a magnetic drive circuit (not shown) including voice coils 703, a magnet 704, and the like. Each of the first driver unit 7*a* and the second driver unit 7*b* is electrically connected to the lead 602 in the cable 6. The magnet 704 is fixedly bonded to the frame 701. The voice coils 703 are fixedly bonded to one surface of the diaphragm 702 on the magnet 704 side. The suspension 705 is formed of an elastic body such as a rubber member, and holds the diaphragm 702 in a manner that one end thereof is fixedly bonded to an outer periphery of the diaphragm 702 and the other end thereof is fixedly bonded to the frame 701. The diaphragm 702 in a state of being held by the suspension 705 is vertically movable by the elasticity of the suspension 705.

When an audio signal, is input via the lead 602, the first driver unit 7*a* and the second driver unit 7*b* generate a magnetic field by a magnetic circuit including the magnet 704, the voice coils 703, and the like. 3*y* the action of the magnetic field, the voice coils 703 vibrate and the diaphragm 702 fixedly bonded to the voice coils 703 vertically vibrates, thereby emitting an audio signal.

As illustrated in FIG. 2, the housing 2 has a space 9 provided therein. The space 9 is in a state of being open to the outside via the hole 204. As illustrated in FIG. 2, the first driver-unit 7*a* and the second driver unit 7*b* are arranged in parallel with, each, other so that the diaphragms 702 thereof are opposed to each other. Further, as illustrated in FIG. 2, the hole 204 which opens to the outside from the space 9 is provided at a position which is substantially perpendicular to the first driver unit 7*a* and the second driver unit 7*b*.

As illustrated in FIG. 1 and FIG. 2, the headphone device 1 inputs via the input terminal 8 an audio signal which is output from the output terminal of the playback device described in Background Art, and emits, from the first driver unit 7*a* and the second driver unit 7*b* via the cable 6, the audio signal which is input from the input terminal 8. A user of the headphone device 1 reproduces the audio signal from the playback device under a state in which the ear pad 4 is inserted into the user's ear and, for example, the playback device is in a pocket of the user's clothes. With, this, the audio signal reproduced by the playback device is emitted by the first driver unit 7*a* and the second driver unit 7*b* via the input terminal 8 and the cable 6. The emitted audio signal is transferred to the inside of the hole 401 in the ear pad 4 via the hole 204 in the housing 2. This transfers the audio signal to the ear of the user to which the ear pad 4 is attached, and the user can listen to the audio signal which is output from the headphone device 1.

Figure 3:
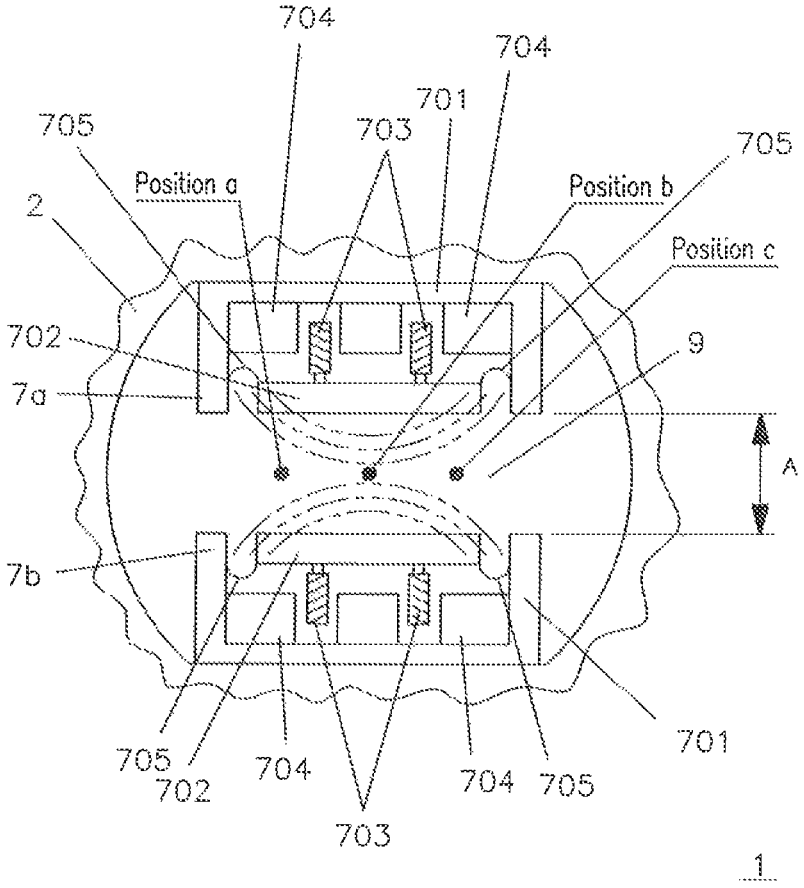
FIG. 3 is a view illustrating the headphone device 1 of this embodiment, under a state in which each of a first driver unit 7*a* and a second driver unit 7*b* emits an audio signal.

FIG. 3 is a view illustrating the headphone device 1 of this embodiment under a state in which each of the first driver unit 7*a* and the second driver unit 7*b* emits an audio signal.

In the headphone device 1 illustrated in FIG. 3, the left direction is to the front, of the headphone device 1, the upward direction is to the top of the headphone device 1, and the downward direction is to the bottom of the headphone device 1.

As illustrated in FIG. 3, an arrangement is made so that the distance from the diaphragm 702 of the first driver unit 7*a* to the diaphragm 702 of the second driver unit 7*b* is a predetermined distance A. In this embodiment, the distance A is approximately 2 mm.

As illustrated in FIG. 3, under a state in which each of the first driver unit 7*a* and the second driver unit 7*b* emits an audio signal, a magnetic flux is generated by a magnetic field which is emitted from each of the first driver unit 7*a* and the second driver unit 7*b*.

Figure 4:
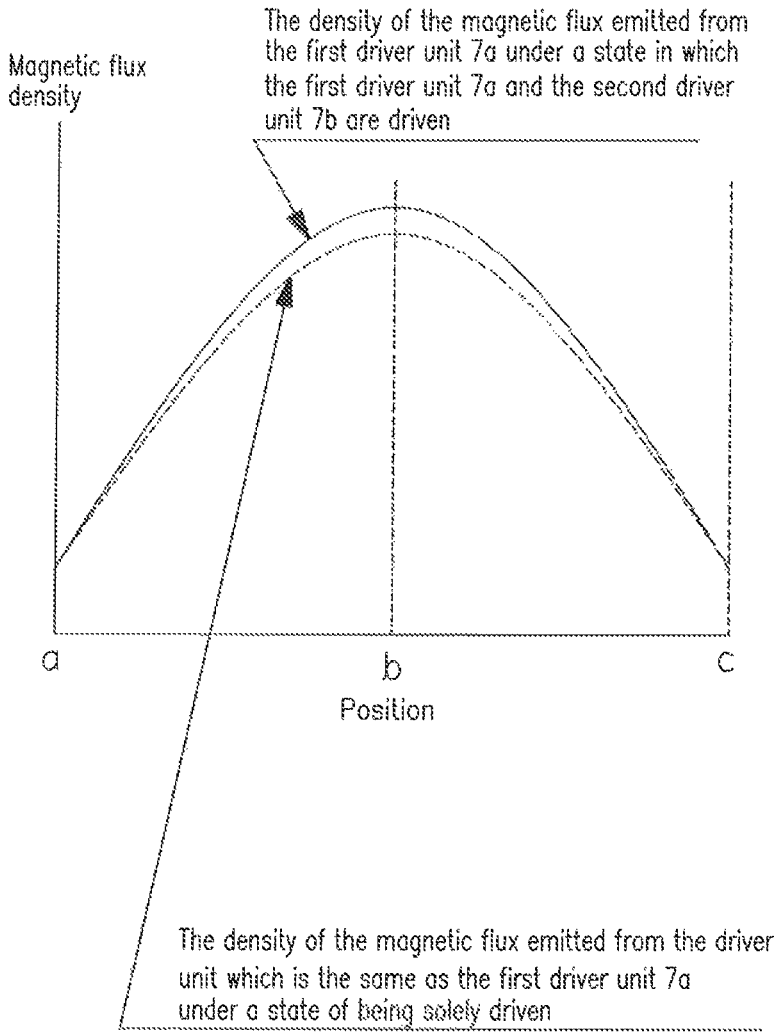
FIG. 4 is a graph showing the result of measurement at a position a, a position b, and a position c of the density of a magnetic flux emitted from the first driver unit 7*a* under a state in which the first driver unit 7*a* and the second driver unit 7*b* are driven, in the headphone device 1 of this embodiment and the result of measurement at the position a, the position b, and the position c of the density of a magnetic flux emitted from a driver unit which is the same as the first driver unit 7*a* under a state of being solely driven.

FIG. 4 is a graph showing the result of measurement at a position a, a position b, and a position c illustrated in FIG. 3 of the density of the magnetic flux emitted from the first driver unit 7*a* under a state in which the first driver unit 7*a* and the second driver unit 7*b* are driven in the headphone device 1 of this embodiment, and the result of measurement at the position a, the position, b, and the position c illustrated in FIG. 3 of the density of a magnetic flux emitted, from a driver unit which is the same as the first driver unit 7*a* under a state of being solely driven.

As illustrated in FIG. 3, by driving the driver units under a state in which, the first driver unit 7*a* and the second driver unit 7*b* are arranged so that the diaphragms 702 thereof are opposed to each other and so that the distance from, the diaphragm 702 of the first driver unit 7*a* to the diaphragm 702 of the second driver unit 7*b* is approximately 2 mm, the magnetic fields emitted from the respective driver units act on each other to change the magnetic fluxes emitted from, the respective driver units. As a result, as shown in FIG. 4, at the position b illustrated in FIG. 3, the density of the magnetic flux emitted from the first driver unit 7*a* under a state in which the first driver unit 7*a* and the second driver unit 7*b* are driven is higher than the density of the magnetic flux emitted from, the driver unit which is the same as the first driver unit 7*a* under a state of being solely driven.

Further, verification experiments snow that, as in the headphone device 1 of this embodiment described above, by driving the driver units under a state in which the first driver unit 7*a* and the second driver unit 7*b* are arranged in the housing 2, and the first driver unit 7*a* and the second driver unit 7*b* are arranged so that the diaphragms 702 thereof are opposed to each other and so that the distance from the diaphragm 702 of the first driver unit 7*a* to the diaphragm 702 of the second driver unit 7*b* is approximately 2 mm, the sound pressure of the emitted audio signal can be increased by about 5 dB to about 8 dB.

As described above, in the headphone device 1 of this embodiment, by driving the driver units under a state in which the first driver unit 7*a* and the second driver unit 7*b* are arranged so that the diaphragms 702 thereof are opposed to each other and so that the distance from the diaphragm 702 of the first driver unit 7*a* to the diaphragm 702 of the second driver unit 7*b* is approximately 2 mm, the density of the magnetic flux emitted from the first driver unit 7*a* under a state in which the first driver unit 7*a* and the second driver unit 7*b* are driven is higher than the density of the magnetic flux emitted from the driver unit which is the same as the first driver unit 7*a* under a state of being solely driven. Therefore, compared with the case in which, the driver unit is solely driven, the state in which the first driver unit 7*a* and the second driver unit 7*b* are arranged so that the diaphragms 702 thereof are opposed to each other and so that the distance from the diaphragm 702 of the first driver unit 7*a* to the diaphragm 702 of the second driver unit 7*b* is approximately 2 mm can increase the emitted audio signal.

In this way, in the headphone device 1 of this embodiment, by arranging in the housing 2 the two small driver units which are the first driver unit 7*a* and the second driver unit 7*b*, the size of the housing 2 can be reduced compared with a case in which a large driver unit is provided in the housing. Further, in the headphone device 1 of this embodiment, by driving the driver units under a state in which, the first driver unit 7*a* and the second, driver unit 7*b* are arranged so that the diaphragms 702 thereof are opposed to each other and so that the distance from the diaphragm 702 of the first driver unit 7*a* to the diaphragm 702 of the second driver unit 7*b* is approximately 2 mm, audio signals which are emitted from the first driver unit 7*a* and the second driver unit 7*b*, respectively, can be increased, and thus, power consumption required for the headphone device 1 to output an audio signal can be reduced. As a result, a contribution can be made to power saving of the headphone device. Further, in the headphone device 1 of this embodiment, audio signals which are emitted from the first driver unit 7*a* and the second driver unit 7*b*, respectively, can be increased, and thus, even when, for example, an audio signal at a certain output level is output from the playback device, compared with a headphone device which does not include the structure of this embodiment, an audio signal of high sensitivity and high sound quality can be emitted.

As illustrated in FIG. 3, in the headphone device 1 of this embodiment, the distance A from the diaphragm 702 of the first driver unit 7*a* to the diaphragm 702 of the second driver unit 7*b* is approximately 2 mm, but the distance A may be smaller than 2 mm or larger than 2 mm, depending on the driving ability of the first driver unit 7*a* and the second driver unit 7*b*. This can further increase the densities of the magnetic fluxes emitted from the respective driver units as a result of mutual action of the magnetic fields emitted from the respective driver units. The further increase in magnetic flux density further enables acoustic output of an audio signal of high sensitivity and high sound quality with lower power consumption.

As illustrated in FIG. 2, in the headphone device 1 of this embodiment, the hole 204 through which an audio signal that is emitted from the first, driver unit 7*a* and the second driver unit 7*b* is emitted to the outside is provided at a position which is substantially perpendicular to the first driver unit 7*a* and the second driver unit 7*b*. However, the present invention is not limited thereto, and, for example, the hole 204 may be provided at a position which is in parallel with the first driver unit 7*a* and the second driver unit 7*b*, or the hole 204 may be provided at a position which is offset by 1 degree to 89 degrees from an angle that is horizontal or perpendicular to the drivers. This changes an angle with which an audio signal emitted from, the first driver unit 7*a* and the second driver unit 7*b* is emitted to the outside, and thus, the frequency characteristics of an audio signal, which is emitted from the hole 204 can be changed, and an audio signal, having a frequency characteristics which, is optimum for the user can be emitted.

In the headphone device 1 of this embodiment, the first driver unit 7*a* and the second driver unit 7*b* are arranged in parallel with, each other so that the diaphragms 702 thereof are opposed to each other, but the diaphragms 702 of the first driver unit 7*a* and the second driver unit 7*b* may be arranged, under a state of being slanted by a certain angle, rather than in parallel with each other. For example, in the housing 2 and the hole 204 illustrated in FIG. 2, the first driver unit 7*a* and the second driver unit 7*b* may be arranged so that the diaphragms 702 of the first driver unit 7*a* and the second, driver unit 7*b* are slanted by an angle of 30 degrees with respect to the direction of the hole 204. With this, an audio signal which is emitted from the diaphragms 702 of the first driver unit 7*a* and the second driver unit 7*b* is easily emitted in the direction of the hole 204, and thus, an audio signal which is emitted by the headphone device 1 can have still higher sound quality.

In the headphone device 1 of this embodiment, the housing 2 is in the shape of a sphere, but the present invention is not limited thereto, and the housing 2 may be in any shape such as a cube, a rectangular parallelepiped, and a polyhedron insofar as a space is provided therein. Further, in the headphone device 1 of this embodiment, an audio signal is input, via the cable 6, but the present invention is not limited thereto, and, for example, an audio signal may be input via radio transmitting means such as infrared transmission and radio transmission. Further, in the headphone device 1 of this embodiment, two driver units which are the first driver unit 7*a* and the second driver unit 7*b* are included, but the present invention is not limited thereto and three or more driver units may be included therein.

In the headphone device 1 of this embodiment, the first driver unit 7*a* and the second driver unit 7*b* are arranged so that the diaphragms 702 thereof are opposed to each other, but the present invention is not limited to the arrangement, and, for example, the first driver unit 7*a* and the second driver unit 7*b* may be arranged so that a rear surface of the first driver unit 7*a* which is opposite to the diaphragm 702 and a rear surface of the second driver unit 7*b* which is opposite to the diaphragm 702 may be opposed to each other. This can further reduce the distance between the magnetic circuit portion of the first driver unit 7*a* and the magnetic circuit portion of the second, driver unit 7*b*, and thus, the densities of the magnetic fluxes emitted from the respective driver units can be further increased as a result of mutual action of the magnetic fields emitted, from the respective driver units. The further increase in magnetic flux density enables acoustic output, of an audio signal of higher sensitivity and higher sound quality with lower power consumption.

INDUSTRIAL APPLICABILITY

The present invention can be usefully used for a headphone device which is to be connected to a playback device to output an audio signal that is output from the playback device.

REFERENCE SIGNS LIST headphone device 1, 2 housing, 202 protrusion, 203 groove portion, 204 hole, 205 hole,
4 ear pad, 401 hole, 402 flange portion, 5 bush, 503 hole, 6 cable, 602 lead,
7*a* first driver unit, 7*b* second driver unit,
701 frame, 702 diaphragm, 703 voice coil, 704 magnet, 705 suspension,
8 input terminal, 9 space, 10 playback device, 11 output terminal,
100 headphone device, 200 housing, 300 front portion

The invention claimed is:

1. A headphone device for outputting an input audio signal, comprising:

a first housing and a second housing, the first housing and second housing each forming a hemispherical shape, the first and second housing together forming a combined housing having a generally spherical shape with a cavity formed therein by overlapping edges of the first housing and second housing, the combined housing comprising a protrusion at a front thereof, the protrusion having a through hole in a fore-and-aft direction; and a first driver unit being fixed to an inner wall of the first housing and a second driver unit fixed to an inner wall of the second housing, the first and second driver unit each comprising a diaphragm for emitting an input audio signal, wherein the first driver unit and the second driver unit are arranged in parallel with each other so that the diaphragms thereof are opposed to each other.

2. A headphone device for outputting an input audio signal, comprising:

a first housing and a second housing, the first housing and second housing each forming a hemispherical shape, the first and second housing together forming a combined housing having a generally spherical shape with a cavity formed therein by overlapping edges of the first housing and second housing, the combined housing comprising a protrusion at a front thereof, the protrusion having a through hole in a fore-and-aft direction; and a first driver unit fixed to an inner wall of the first housing and a second driver unit fixed to an inner wall of the second housing, the first and second driver unit each comprising a diaphragm for emitting an input audio signal, wherein the first driver unit and the second driver unit are arranged so that the diaphragms thereof are opposed to each other and the diaphragms are slanted by a predetermined angle.

3. A headphone device according to claim 1, wherein a distance from the diaphragm of the first driver unit to the diaphragm of the second driver unit is approximately 2 mm.

4. A headphone device according to claim 1, wherein the through hole is provided at a position which is substantially perpendicular to the first driver unit and the second driver unit.

5. A headphone device according to claim 2, wherein a distance from the diaphragm of the first driver unit to the diaphragm of the second driver unit is approximately 2 mm.

6. A headphone device according to claim 2, wherein the through hole is provided at a position which is substantially perpendicular to the first driver unit and the second driver unit.

7. A headphone device according to claim 1, wherein the first housing and the second housing are symmetrical in shape.

8. A headphone device according to claim 2, wherein the first housing and the second housing are symmetrical in shape.

9. A headphone device for outputting an input audio signal, comprising:

a first housing and a second housing, the first housing and second housing each forming a hemispherical shape, the first and second housing together forming a combined housing having a generally spherical shape with a cavity formed therein by overlapping edges of the first housing and second housing, the combined housing comprising a protrusion at a front thereof, the protrusion having a through hole in a fore-and-aft direction; and a first driver unit fixed to an inner wall of the first housing and a second driver unit fixed to an inner wall of the second housing, the first and second driver unit each comprising a diaphragm for emitting an input audio signal, wherein (1) the first driver unit and the second driver unit are arranged in parallel with each other so that the diaphragms thereof are opposed to each other, or (2) the first driver unit and the second driver unit are arranged so that the diaphragms thereof are opposed to each other and the diaphragms are slanted by a predetermined angle, and wherein the diaphragm of the first driver unit is disposed at a distance away from the diaphragm of the second driver unit such that the distance provides an increased sound pressure of an audio signal emitted from the headphone device.

10. A headphone device according to claim 9, wherein the distance from the diaphragm of the first driver unit to the diaphragm of the second driver unit is approximately 2 mm.

* * * * *